US008182217B2

(12) United States Patent
Schaffer et al.

(10) Patent No.: US 8,182,217 B2
(45) Date of Patent: May 22, 2012

(54) MECHANICAL FAN SUB-SHROUD ATTACHMENT FEATURE, MOLDED PLASTIC SNAP FEATURE

(75) Inventors: John S. Schaffer, Farmington Hills, MI (US); Christopher Wisniewski, Ann Arbor, MI (US); Michael Tucker, Livonia, MI (US)

(73) Assignee: DENSO International America, Inc., Southfield, MI (US)

( * ) Notice: Subject to any disclaimer, the term of this patent is extended or adjusted under 35 U.S.C. 154(b) by 1227 days.

(21) Appl. No.: 11/731,897

(22) Filed: Mar. 30, 2007

(65) Prior Publication Data

US 2008/0236518 A1 Oct. 2, 2008

(51) Int. Cl.
*F01D 25/24* (2006.01)

(52) U.S. Cl. ..... 415/214.1; 415/220

(58) Field of Classification Search ..... 415/173.1, 415/213.1, 214.1, 220; 416/169 A
See application file for complete search history.

(56) References Cited

U.S. PATENT DOCUMENTS 4,018,297 A * 4/1977 Haupt ..... 180/68.1
4,244,612 A 1/1981 Schurman
4,353,680 A * 10/1982 Hiraoka et al. ..... 415/222
4,741,669 A 5/1988 Shimokawabe
5,410,992 A * 5/1995 Hunt et al. ..... 123/41.49
6,041,744 A 3/2000 Oota et al.
6,189,492 B1 2/2001 Brown
6,233,791 B1 * 5/2001 Theis ..... 24/135 R
7,044,203 B2 5/2006 Yagi et al.
7,077,624 B2 * 7/2006 Brown ..... 415/126
7,137,439 B2 11/2006 Hoshino
7,481,287 B2 * 1/2009 Madson et al. ..... 180/68.1
2006/0081353 A1 * 4/2006 Inniger et al. ..... 165/41
2006/0272800 A1 * 12/2006 Wong et al. ..... 165/120

* cited by examiner

*Primary Examiner* — Edward Look
*Assistant Examiner* — Sean J Younger
(74) *Attorney, Agent, or Firm* — Harness, Dickey & Pierce, PLC

(57) ABSTRACT

A fan shroud assembly includes a fixed fan shroud and a removable fan shroud. An upper retention system integral with the fixed and removable fan shrouds secures the two circumferential ends of the removable fan shroud to the fixed fan shroud. A lower retention system integral with the fixed and removable fan shroud secures the center of the removable fan shroud to the fixed fan shroud. No additional fasteners are required to connect the removable fan shroud to the fixed fan shroud because of the integral nature of the upper and lower retention systems.

12 Claims, 7 Drawing Sheets

MECHANICAL FAN SUB-SHROUD ATTACHMENT FEATURE, MOLDED PLASTIC SNAP FEATURE

FIELD

The present disclosure relates to fan shrouds for use in the engine compartment of automobiles. More particularly, the present disclosure relates to a two piece fan shroud assembly that snaps together in one simple motion to provide a sturdy and reliable assembly.

BACKGROUND

The statements in this section merely provide background information related to the present disclosure and may not constitute prior art.

Automotive vehicles typically utilize an internal combustion engine to provide the power to operate the vehicle. Internal combustion engines generate heat due to the combustion process and it is necessary to continuously remove the excess heat from the vehicle's engine in order to maintain the operating temperature of the vehicle's engine at a specified level.

The usual method of removing this excess heat is an automotive cooling system. The cooling system utilizes a coolant pump which pumps coolant through the vehicle's engine to absorb the excess heat and then this heated fluid is pumped to a heat exchanger or radiator which removes the excess heat by performing a heat exchange process with ambient air. The coolant which has been cooled by the radiator is returned to the engine and the process continuously repeats itself. Typically, the temperature of the coolant is maintained at a minimum level using a thermostat or some other type of control system.

In order to reduce the size and thus the costs of the radiator, the automotive designer strives to have the radiator operate in the most efficient manner. One method used to maximize the efficiency of the radiator is to control the flow of ambient air through the radiator. This is accomplished by providing a fan which draws the ambient air through the radiator and then providing a fan shroud which ensures that the maximum amount of air is drawn through the radiator.

Automotive fans for the cooling system can be electrically driven or they can be driven by the vehicle's engine. Regardless of how they are driven, the maximization of ambient air flow requires that the fan be located within the fan shroud. The use of a fan that is driven by the engine and a fan shroud which is attached to the radiator presents problems during the assembly of the vehicle. In many cases, the vehicle frame, drive train and suspension are constructed first and the fan is attached to the driving component of the engine such as a coolant pump pulley or the crankshaft of the engine. The vehicle's body, including the radiator and fan shroud, is not assembled to the frame, drive train and suspension assembly until near the end of the assembly line. Since the fan needs to be located within the fan shroud, an interference/clearance issue is created when the body, including the radiator and fan shroud are lowered onto the frame.

This interference/clearance issue has been addressed by designing the fan shroud such that it has a removable portion at the bottom of the shroud in order to provide clearance for the fan during the assembly of the body to the frame. Once the body has been assembled to the frame, the removable portion is attached to the fixed portion of the shroud to avoid significant air loss through the radiator.

The connection between the removable portion and the fixed portion must be very secure. If it were to become detached during the life of the vehicle, it could lead to undercooling of the vehicle's engine due to a loss of ambient air through the radiator, or it could come loose and interfere with and possibly damage the fan itself. While it is necessary to adequately secure the removable portion to the fixed portion of the shroud, it still needs to be removable for any service required to the fan. Typically, the only access to the fan is through the removable portion of the fan shroud. Finally, the assembly of the removable portion to the fixed portion of the fan shroud has to be a simple and rapid assembly process in order to accommodate the vehicle as it moves down the assembly line.

SUMMARY

The present disclosure provides a two-piece fan shroud which includes a removable portion and a fixed portion. The assembly of the two pieces is accomplished using a locating feature and an integral clip thus eliminating the need of any additional fasteners. The assembly of the two pieces can be completed in seconds using a single hand from underneath the vehicle. The assembled fan shroud is robust and secure yet the fan shroud can still be disassembled easily for any service that is required.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
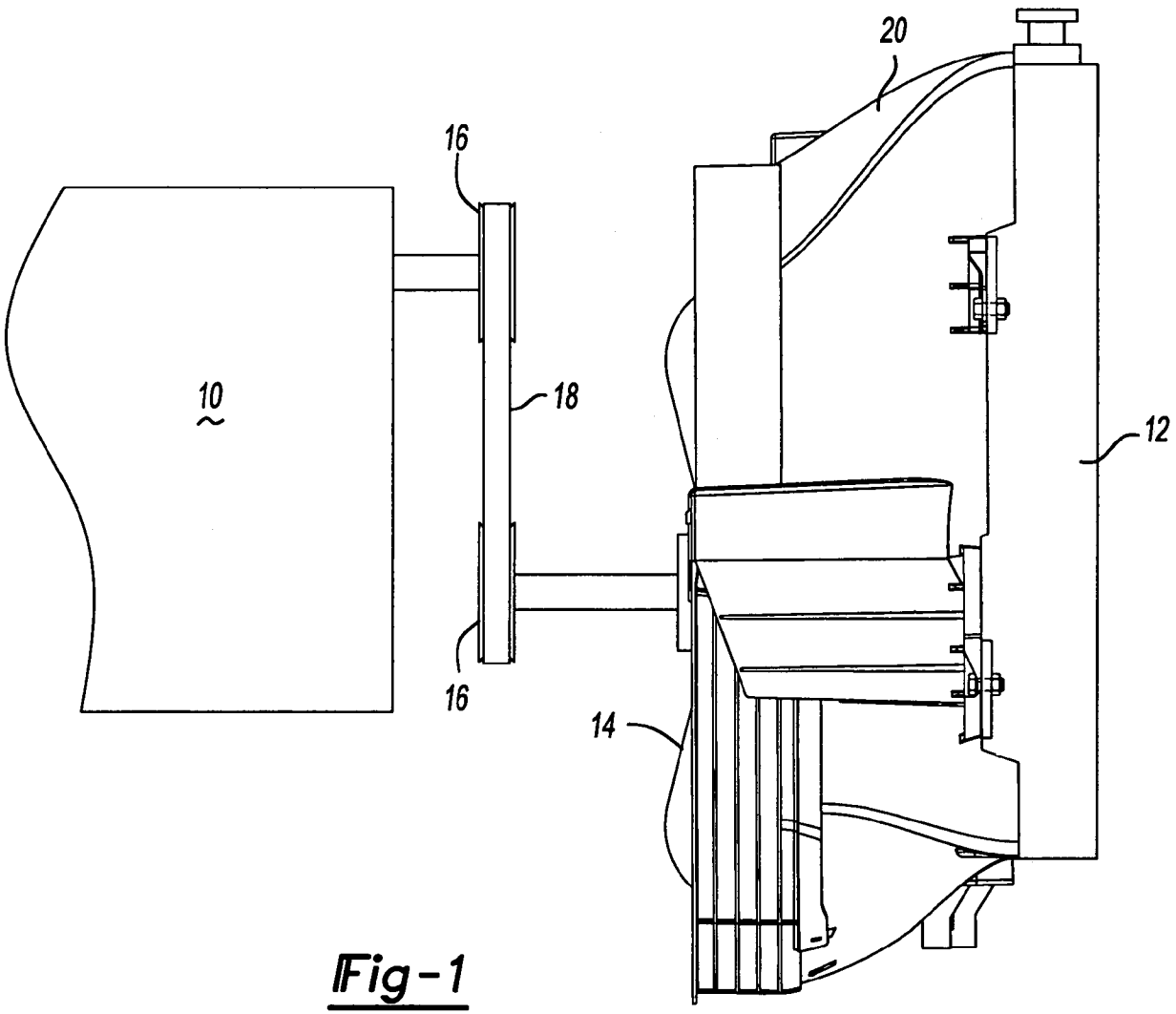
FIG. 1 is a side elevation schematic view illustrating an automotive engine, a radiator, a cooling fan and a fan shroud in accordance with the present disclosure.

The following description is merely exemplary in nature and is not intended to limit the present disclosure, application, or uses. FIG. 1 schematically illustrates an automotive engine 10 positioned behind a radiator 12 as is typically seen in an engine compartment of a vehicle. A pair of hoses (not shown) are corrected between engine 10 and radiator 12 to provide for the flow of coolant. A coolant fan 14 is located between engine 10 and radiator 12 and coolant fan 14 is rotated by engine 10 using pulleys 16 and a drive belt 18. While coolant fan 14 is illustrated being driven by pulleys 16 and drive belt 18, it is within the scope of the present invention to have coolant fan 14 driven directly by engine 10, be driven by an electric motor (not shown) or by any other means for driving coolant fan 14.

A fan shroud assembly 20 is attached to radiator 12 and located in a position that circumferentially surrounds coolant fan 14 in a generally coaxial relationship. When coolant fan 14 is rotated, ambient air from in front of radiator 12 is drawn through radiator 12 to cool the coolant flowing between engine 10 and radiator 12. Fan shroud assembly 20 covers the rear portion of radiator 12 to ensure that only ambient air from in front of radiator 12 is drawn through radiator 12 in order to maximize the ambient air flow through radiator 12 and thus maximize its cooling capacity Fan shroud assembly 20 comprises a fixed fan shroud 30 and a removable fan shroud 32 both of which are molded plastic components. While fixed fan shroud 30 and removable fan shroud 32 are described as plastic components, it is within the scope of the present invention to utilize any suitable material for fixed fan shroud 30 and removable fan shroud 32. Removable fan shroud 32 is detachable from fixed fan shroud 30 to create an opening 34 which provides clearance for coolant fan 14 during the assembly of the vehicle's body to the vehicle's frame.

Fixed fan shroud 30 includes a generally rectangular portion 36 at one end which transitions into a generally circular portion 38. A semi-circular flange 40 extends axially from circular portion 38 to provide a portion of fan shroud assembly 20 within which coolant fan 14 is located. Fixed fan shroud 30 defines a plurality of mounting supports 42 which are utilized to secure fixed fan shroud 30 to radiator 12.

Removable fan shroud 32 includes a semi-circular portion 44 which mates with semi-circular flange 40 to define a generally circular aperture 46 within which coolant fan 14 is located as illustrated in FIG. 1. Removable fan shroud 32 is secured to fixed fan shroud 30 using an upper latching system 48 and a lower latching system 50.

Upper latching system 48 includes a pair of latches 52, with each latch 52 being located on an opposite end or side of fan shroud assembly 20. Since both latches 52 are identical except for being on opposite ends or sides of fan shroud assembly 20, only one latch 52 will be detailed. It is to be understood that the opposite latch 52 includes the same elements as those detailed below.

Latch 52 includes a female portion 54 located on fixed fan shroud 30 and a male portion 56 located on removable fan shroud 32. Female portion 54 includes a generally rectangular housing 60 which defines an aperture or slot 62 which is open toward the lower portion of fixed fan shroud 30 where removable fan shroud 32 is assembled. An angular wall 64 extends downward from rectangular housing 60 to provide a guiding surface for male portion 56 as described below. A rear wall 66 of rectangular housing 60 defines a retention opening 68 for retaining male portion 56 also as is detailed below.

Male portion 56 includes a retention finger 70 which circumferentially extends from opposite circumferential ends of semi-circular portion 44 of removable fan shroud 32 to engage female portion 54 of fixed fan shroud 30. Retention finger 70 defines a retention tab 72 which engages with retention opening 68 to secure removable fan shroud 32 to fixed fan shroud 30 as detailed below.

Lower latching system 50 comprises a plurality of retention walls 80 extending from semi-circular portion 44 of removable fan shroud 32. The present disclosure illustrates three retention walls 80 but there can be two or more retention walls 80 if desired. The plurality of retention walls 80 illustrated includes a first retention wall 82, a second retention wall 84 and a third retention wall 86 arranged circumferentially along a forward edge of semi-circular portion 44 of removable fan shroud 32. Retention walls 82-86 extend generally over the entire inner circumferential edge of semi-circular portion 44 with a gap 88 being located on opposite sides of second retention wall 84.

Figure 2:
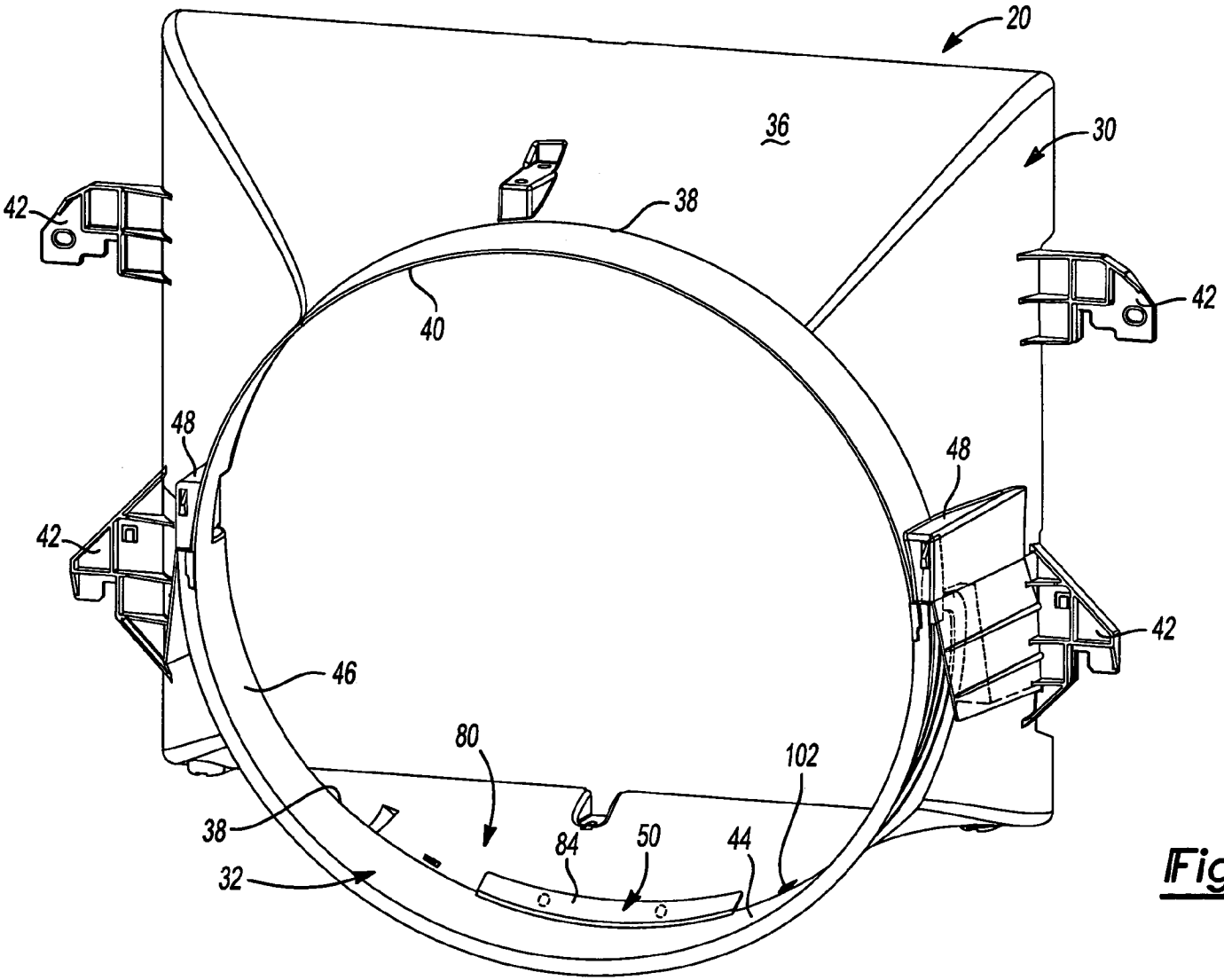
FIG. 2 is a rear perspective view of the fan shroud assembly in accordance with the present disclosure.
Figure 7:
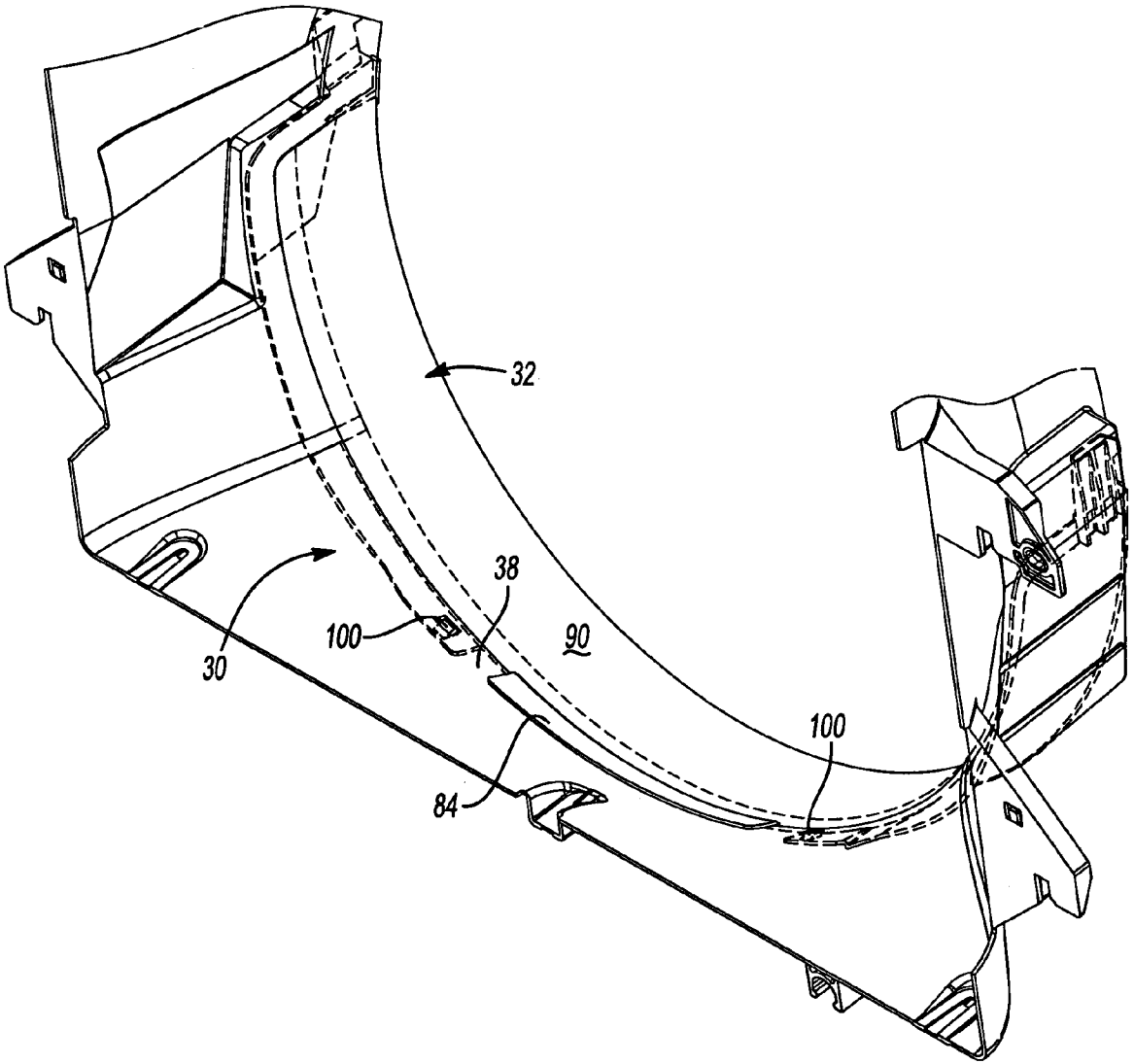
FIG. 7 is an exploded front perspective view of the fan shroud assembly illustrated in FIG. 2.
Figure 8:
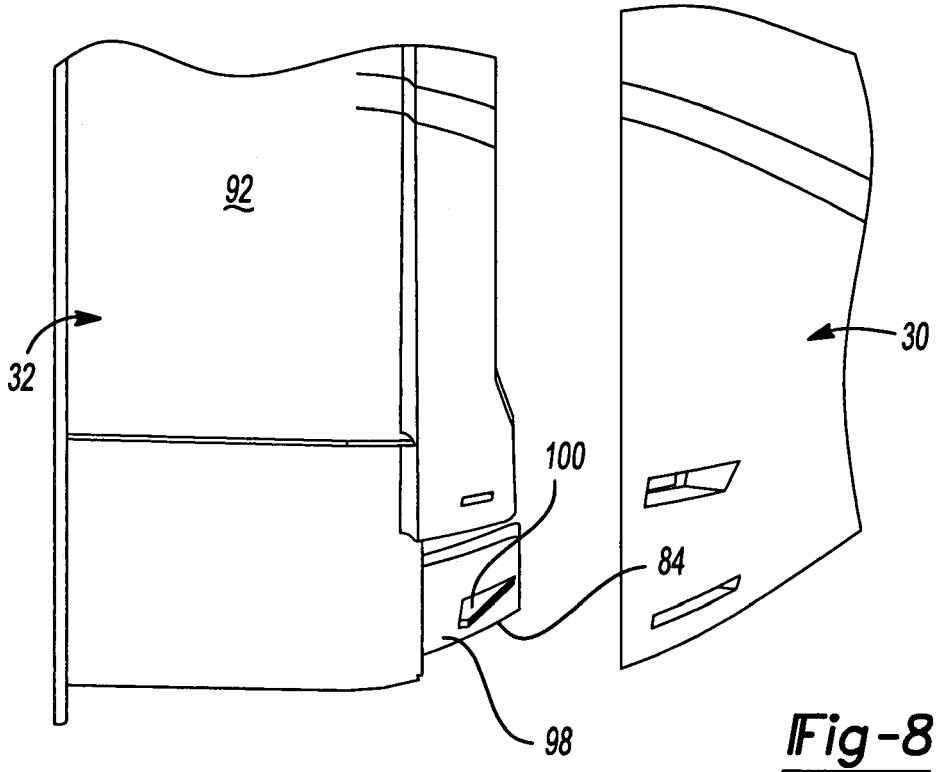
FIG. 8 is an enlarged perspective view of the lower latching system for the fan shroud assembly illustrated in FIG. 2 in an assembled condition.
Figure 9:
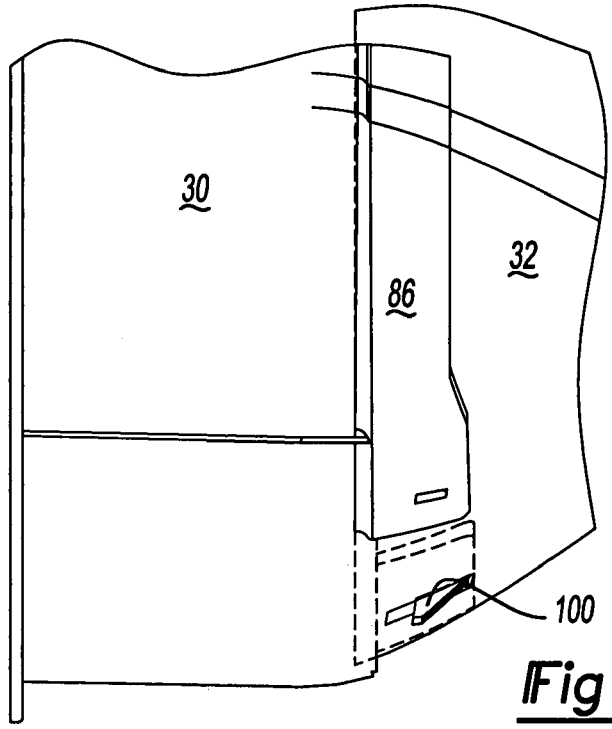
FIG. 9 is an enlarged perspective view of the lower latching system for the fan shroud assembly illustrated in FIG. 2 in an assembled condition.

Second retention wall 84 is disposed between first and third retention walls 82 and 86. Second retention wall 84 extends from an inside surface 90 of semi-circular portion 44 while first and third retention walls 82 and 86 extend from an outside surface 92 of semi-circular portion 44. Thus, as illustrated in FIGS. 2 and 7, when removable fan shroud 32 is assembled to fixed fan shroud 30, circular portion 38 of fixed fan shroud 30 is sandwiched between second retention wall 84 and first and third retention walls 82 and 86. While second retention wall 84 is disclosed as extending from inside surface 90 and first and third retention walls 82 and 86 are disclosed as extending from outside surface 92, it is within the scope of the present invention to have second retention wall 84 extending from outside surface 92 and first and third retention walls 82 and 86 extending from inside surface 90 if desired.

An inside surface 94 of first retention wall 82, an inside surface 96 of second retention wall 84 and an inside surface 98 of third retention wall 86 each define one or more retaining members 100 which extend radially towards circular portion 38 of fixed fan shroud 30. Circular portion 38 of fixed fan shroud 30 defines a plurality of apertures 102 each of which accepts a respective retaining member 100 to secure removable fan shroud 32 to fixed fan shroud 30.

Figure 3:
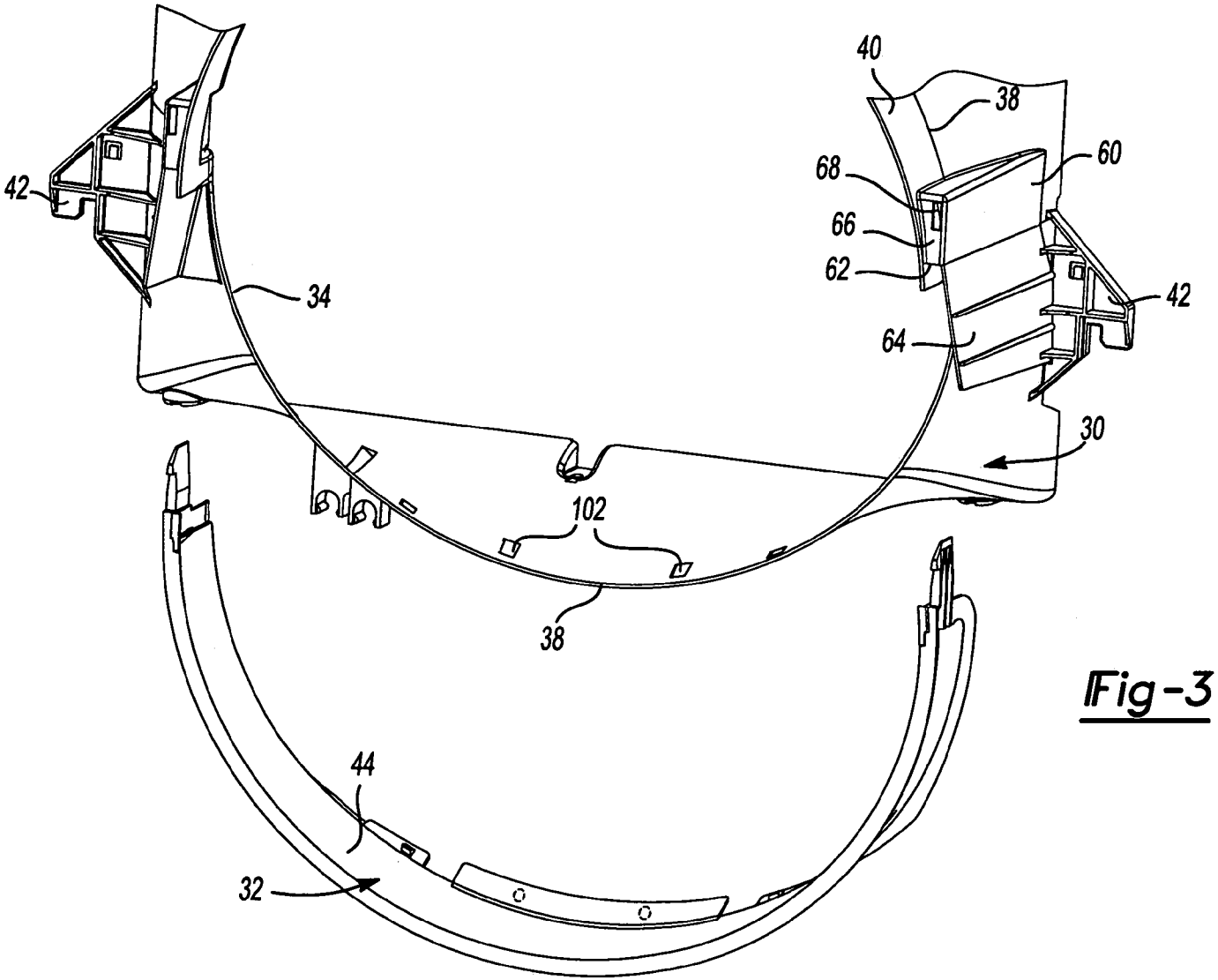
FIG. 3 is an exploded rear perspective view of the fan shroud assembly illustrated in FIG. 2.
Figure 5:
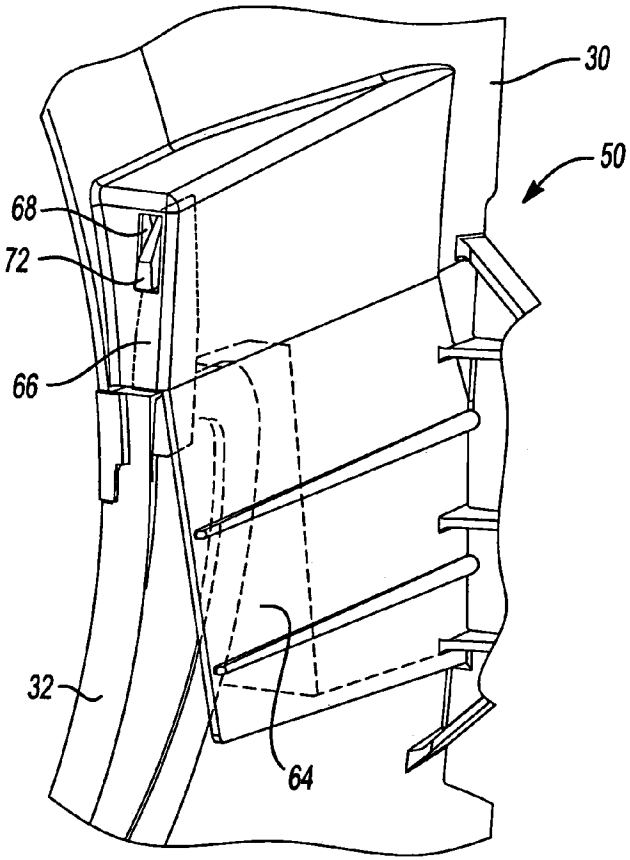
FIG. 5 is an enlarged perspective view of the upper latching system for the fan shroud assembly illustrated in FIG. 2 in an assembled condition.
Figure 4:
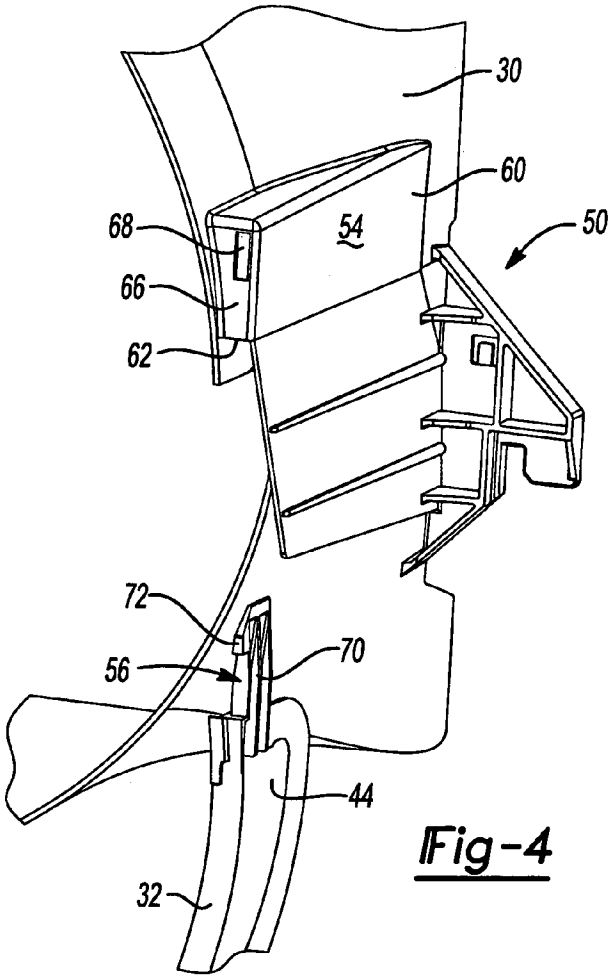
FIG. 4 is an enlarged perspective view of the upper latching system for the fan shroud assembly illustrated in FIG. 2 in an unassembled condition.
Figure 6:
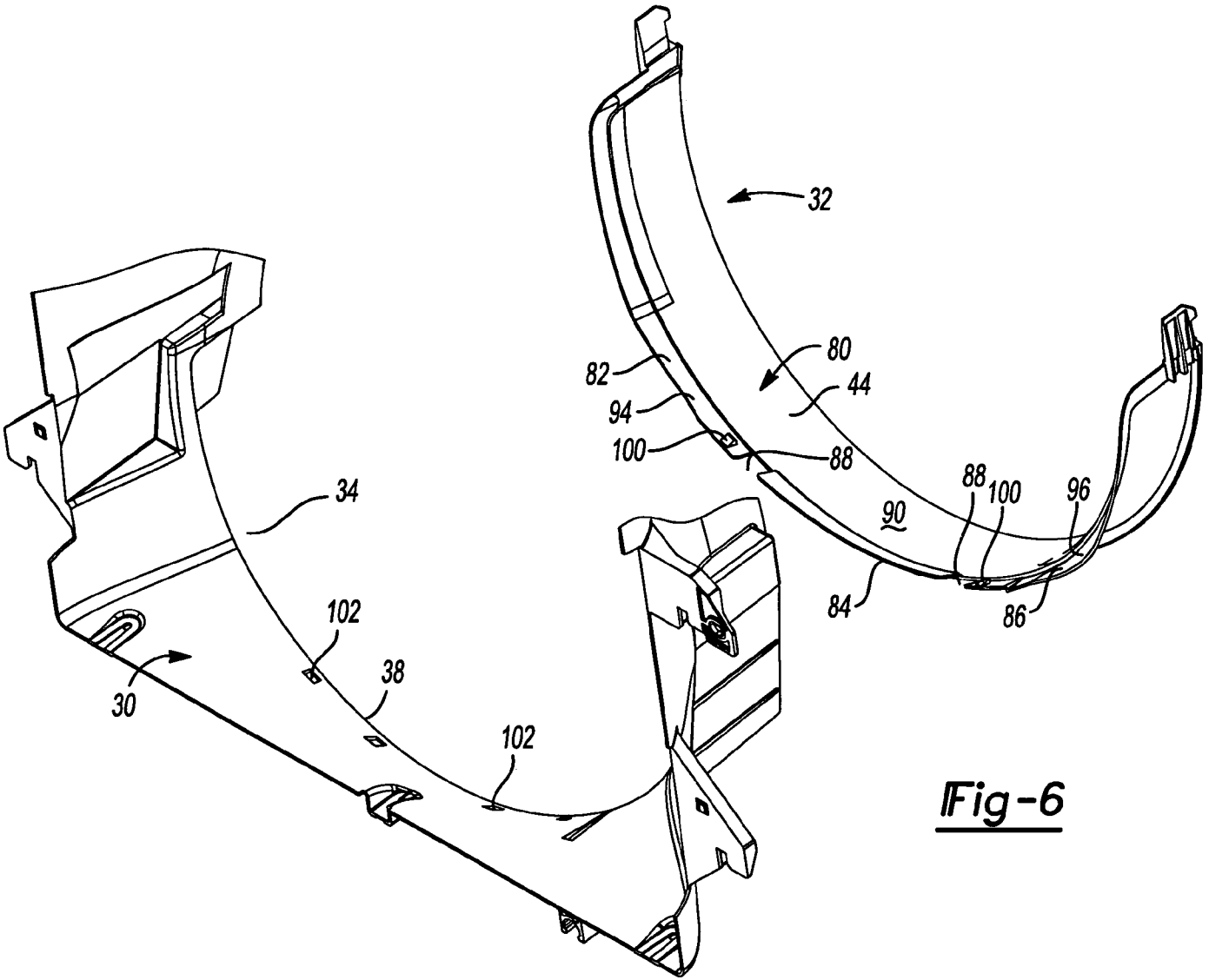
FIG. 6 is an exploded front perspective view of the fan shroud assembly illustrated in FIG. 2.

The assembly of removable fan shroud 32 to fixed fan shroud 30 begins by aligning removable fan shroud 32 with fixed fan shroud 30 as illustrated in FIG. 3. Then, retention finger 70 of male portion 56 of upper latching system 48 is inserted into aperture 62 of female portion 54 of upper latching system 48 as illustrated in FIGS. 4 and 5. Angular wall 64 will help to guide retention finger 70 into aperture 62. Next, removable fan shroud 32 is moved to sandwich circular portion 38 of fixed fan shroud 30 between retention walls 82-86. Removable fan shroud 32 is urged towards fixed fan shroud 30 until retention members 100 snap into their respective apertures 102 as illustrated in FIG. 7. The movement of removable fan shroud 32 towards fixed fan shroud 30 and the engagement between retaining members 100 and apertures 102 will move retention finger 70 within rectangular housing 60 such that retention tab 72 of retention finger 70 extends through retention opening 68 of rear wall 66 as is illustrated in FIG. 5.

The assembly of removable fan shroud 32 to fixed fan shroud 30 to create fan shroud assembly 20 is completed without the use of additional fasteners or clips. Thus, the assembly can be completed by hand in a minimum of time without using tools. The assembled fan shroud assembly 20 is a robust design because of the circumferential length of retention walls 82-86 and it can be easily disassembled by releasing retaining members 100 from apertures 102 which will allow the rotation of removable fan shroud 32 such that retention tabs 72 will be released from retention openings 68 thus allowing for the easy removal of removable fan shroud 32.

What is claimed is:

1. A fan shroud assembly comprising:

a fixed fan shroud;

a removable fan shroud attached to the fixed fan shroud;

an upper retention system securing opposite ends of the removable fan shroud to the fixed fan shroud; and a lower retention system securing a center section between the opposite ends of the removable fan shroud to the fixed fan shroud, wherein:

the upper retention system includes a first retention finger circumferentially extending upwardly from a first circumferential end of the removable fan shroud and a second retention finger circumferentially extending upwardly from a second circumferential end of the removable fan shroud, the upper retention system further comprising a first and a second rectangular housing attached to the fixed fan shroud on three sides, each of said first and second rectangular housings having a downward orientated aperture, the first retention finger being slidingly received in the first housing aperture in a vertically upward motion, and the second retention finger being slidingly received in the second housing in a vertically upward motion, the lower retention system includes at least one first retention wall extending from an inside surface of the removable fan shroud and at least one second retention wall extending from an outside surface of the removable fan shroud, said at least one first retention wall and said at least one second retention wall being staggered and extending over an inner circumferential edge around said removable fan shroud, wherein a circumferential gap is positioned between any at least one first retention wall and any adjacent said second retention wall, wherein no radial overlap of said at least one first retention wall and said at least one second retention wall exists, and the fixed fan shroud being positioned between the at least one first and the at least one second retention walls.

2. The fan shroud assembly according to claim 1, wherein the lower retention system includes a first retaining member extending radially from the at least one first retention wall, the first retaining member being disposed within a first aperture defined by the fixed fan shroud.

3. The fan shroud assembly according to claim 2, wherein the lower retention system includes a second retaining member extending radially from the at least one second retention wall, the second retaining member being disposed within a second aperture defined by the fixed fan shroud.

4. The fan shroud assembly according to claim 1, wherein the upper retention system further includes a retention tab extending from each of the first and second retention fingers, each retention tab extending through an opening defined by a respective first and second housing.

5. The fan shroud assembly according to claim 4, wherein the first housing provides a rear wall, the rear wall defines the opening, and the first and the second retention walls extend forward.

6. The fan shroud according to claim 1, wherein at least one of the first and second housings provides an angular wall, the angular wall extends downward to provide a guiding surface for a respective retention finger.

7. A fan shroud assembly comprising:

a fixed fan shroud, the fixed fan shroud provides a semi-circular flange, the semi-circular flange composes an upper half of a circular portion of the fan shroud assembly;

a removable fan shroud attached to the fixed fan shroud, the removable fan shroud provides a semi-circular portion, the semi-circular portion composes a lower half of the circular portion of the fan shroud assembly;

an upper retention system securing opposite ends of the semi-circular portion to the semi-circular flange; and a lower retention system securing a center section of the semi-circular portion to a lower part of the fixed fan shroud, wherein:

the upper retention system includes a first retention finger extending upwardly from a first end of the semi-circular portion and a second retention finger extending upwardly from a second end of the semi-circular portion, the upper retention system further comprising a first and a second rectangular housing attached to the fixed fan shroud on three sides, each of said first and second rectangular housings having a downward orientated aperture, the first retention finger being slidingly received in the first housing aperture in a vertically upward motion, and the second retention finger being slidingly received in the second housing in a vertically upward motion, the lower retention system includes at least one first retention wall extending from an inside surface of the semi-circular portion and at least one second retention wall extending from an outside surface of the semi-circular portion, said at least one first retention wall and said at least one second retention wall being staggered and extending over an inner circumferential edge around said removable fan shroud, wherein a circumferential gap is positioned between any at least one first retention wall and any adjacent said second retention wall, wherein no radial overlap of said at least one first retention wall and said at least one second retention wall exists, and the lower part of the fixed fan shroud being positioned between the at least one first and the at least one second retention walls.

8. The fan shroud according to claim 7, wherein the lower retention system includes a first retaining member extending radially outward from the at least one first retention wall, the first retaining member being disposed within a first aperture defined by the lower part of the fixed fan shroud.

9. The fan shroud according to claim 8, wherein the lower retention system includes a second retaining member extending radially inward from the at least one second retention wall, the second retaining member being disposed within a second aperture defined by the lower part of the fixed fan shroud.

10. The fan shroud according to claim 7, wherein the upper retention system further includes a retention tab extending from at least one of the first and second retention fingers, the retention tab extending through an opening defined by a respective housing.

11. The fan shroud according to claim 10, wherein the first housing provides a rear wall, the rear wall defines the opening, and the first and the second retention wall extending forward.

12. The fan shroud according to claim 7, wherein at least one of the first and second housings provides an angular wall, the angular wall extends downward to provide a guiding surface for a respective retention finger.

* * * * *